US012565991B2

(12) United States Patent
Wünning et al.

(10) Patent No.: US 12,565,991 B2
(45) Date of Patent: Mar. 3, 2026

(54) DEVICE AND METHOD FOR SUPPLYING COMBUSTION AIR AND FOR RECIRCULATING EXHAUST GAS FOR A BURNER

(71) Applicant: WS—Wärmeprozesstechnik GmbH, Renningen (DE)

(72) Inventors: Joachim A. Wünning, Leonberg (DE); Joachim G. Wünning, Leonberg (DE)

(73) Assignee: WS—Wärmeprozesstechnik GmbH, Renningen (DE)

( * ) Notice: Subject to any disclaimer, the term of this patent is extended or adjusted under 35 U.S.C. 154(b) by 352 days.

(21) Appl. No.: 18/265,155

(22) PCT Filed: Nov. 17, 2021

(86) PCT No.: PCT/EP2021/082000

§ 371 (c)(1),
(2) Date: Jun. 2, 2023

(87) PCT Pub. No.: WO2022/117345

PCT Pub. Date: Jun. 9, 2022

(65) Prior Publication Data

US 2024/0060638 A1 Feb. 22, 2024

(30) Foreign Application Priority Data

Dec. 3, 2020 (EP) ..... 20211530

(51) Int. Cl.
*F23C 9/00* (2006.01)
*F23C 7/00* (2006.01)

(52) U.S. Cl.
CPC ..... *F23C 9/006* (2013.01); *F23C 7/008* (2013.01); *F23C 2202/30* (2013.01); *F23C 2202/50* (2013.01); *F23C 2900/09002* (2013.01)

(58) Field of Classification Search
CPC ..... F23C 9/006; F23C 7/008; F23C 2202/30; F23C 2202/50

(Continued)

(56) References Cited

U.S. PATENT DOCUMENTS 4,130,388 A * 12/1978 Flanagan ..... F23C 9/00 431/9
5,154,599 A 10/1992 Wunning (Continued)

FOREIGN PATENT DOCUMENTS

DE 39 23 238 A1 1/1991
DE 199 17 662 A1 11/2000

(Continued)

OTHER PUBLICATIONS

International Search Report issued Jan. 31, 2022 in connection with PCT Application No. PCT/EP2021/082000.

(Continued)

*Primary Examiner* — Vivek K Shirsat
(74) *Attorney, Agent, or Firm* — Blank Rome

(57) ABSTRACT

The invention relates to a device (2) and a method for supplying combustion air and for recirculating exhaust gas for a burner (1) comprising a combustion chamber (10) and to a burner (1) comprising a device (2) for supplying combustion air and for recirculating exhaust gas. Multiple drive nozzles (21) distributed about a central axis (A) are used to supply combustion air to a mixing chamber (22) arranged downstream of the drive nozzles (21) by suctioning exhaust gases out of the combustion chamber (10); the combustion air exiting the drive nozzles (21) is mixed with exhaust gases in the mixing chamber (22) in order to form a combustion air/exhaust gas mixture, said exhaust gases flowing out of the combustion chamber (10) and being backflushed by means of the drive nozzles (21); and the combustion air/exhaust gas mixture is supplied to a reaction zone downstream of the mixing chamber (22).

15 Claims, 3 Drawing Sheets

(58) Field of Classification Search
USPC ..... 431/9, 115–116
See application file for complete search history.

(56) References Cited

U.S. PATENT DOCUMENTS

| | | | | |
|---|---|---|---|---|
| 6,095,792 | A * | 8/2000 | Berger | F23N 1/022 431/9 |
| 6,776,609 | B1 * | 8/2004 | Sullivan | F23L 5/02 431/9 |
| 2014/0272737 | A1 * | 9/2014 | Robertson | F23C 9/006 431/174 |

FOREIGN PATENT DOCUMENTS

| | | | |
|---|---|---|---|
| EP | 0 386 732 | A2 | 9/1990 |
| JP | 538824 | A | 1/1978 |
| JP | H06229510 | A | 8/1994 |
| JP | H06241416 | A | 8/1994 |
| JP | 2007218506 | A | 8/2007 |
| JP | 2009024932 | A | 2/2009 |
| JP | 2011080698 | A | 4/2011 |

OTHER PUBLICATIONS

Extended European Search Report issued Apr. 30, 2021 in connection with European Patent Application No. 20211530.9.

* cited by examiner

DEVICE AND METHOD FOR SUPPLYING COMBUSTION AIR AND FOR RECIRCULATING EXHAUST GAS FOR A BURNER

CROSS-REFERENCE TO RELATED APPLICATIONS

This application is a national phase of PCT/EP2021/082000, filed Nov. 17, 2021, and claims priority to EP 20211530.9, filed Dec. 3, 2020, the entire contents of both of which are hereby incorporated by reference.

TECHNICAL FIELD AND PRIOR ART

The invention relates to a device and to a method for supplying combustion air and for recirculating exhaust gas for a burner, and to a burner having a device for supplying combustion air and for recirculating exhaust gas.

Hydrogen, in particular what is referred to as green hydrogen, which is obtained by water splitting from renewable energy, such as wind energy, solar energy or hydropower, or from biomass, is gaining importance increasingly as an energy source, firstly as an addition to natural gas and later as pure gas. Although hydrogen burns virtually without any emissions, oxygen and nitrogen are constituents of the combustion air, and therefore nitrogen oxides can form even during use of hydrogen. A thermal formation of nitrogen oxides is initiated at high temperatures and then increases exponentially with the temperature. Due to a high reaction rate of the hydrogen, the thermal formation of nitrogen oxides increases significantly through the use of hydrogen in comparison to the use of pure natural gas. For example, without special measures, in the case of burners using natural gas (CH4), there is approximately 50 ppm of nitrogen oxide in the exhaust gas, and, in the case of burners using hydrogen, there is more than 100 ppm of nitrogen oxide in the exhaust gas.

Recirculation of exhaust gas or return of exhaust gas is known to be an effective measure against the thermal formation of nitrogen oxide in the exhaust gas of combustion plants, with return of the exhaust gas reducing an oxygen content and thus lowering a flame temperature. In conjunction with the application, an exhaust gas return ratio (EGR) is defined as the ratio of the mass flows of the recirculated or returned exhaust gas and the supplied combustion air ($m_E/m_A$). The exhaust gases are also referred to as combustion exhaust gases or combustion gases.

Conventionally, a differentiation is made between external and internal recirculation of exhaust gas. In the case of external recirculation of exhaust gas, exhaust gas is conducted out of the combustion chamber and an exhaust gas partial flow in the exhaust gas tract is removed, for example in a chimney, and added to the combustion air or to the fuel before or while flowing into a combustion chamber. An EGR can be adjusted to a desired ratio by means of suitable controllers. A substantial disadvantage of the external recirculation of exhaust gas is an increase in the exhaust gas quantity, and therefore areas for extracting the heat have to be correspondingly increased in size.

In the case of internal recirculation of exhaust gas, exhaust gas or combustion gas present in a combustion chamber is recycled with the pulse of the combustion air into the reaction zone. If a temperature in the combustion chamber lies above an ignition temperature of the fuel, the exhaust gas return ratio can be increased as desired since flame stability is not of any significance.

For example, EP 0 463 218 A1 discloses a method and a device for combusting fuel in a combustion chamber, wherein combustion air emerging from a nozzle device with a number of nozzles arranged in the form of a ring can be mixed with sucked-back exhaust gases, which are partially cooled in the combustion chamber, with the formation of a combustion air/exhaust gas mixture having at least the ignition temperature, in an exhaust gas return ratio EGR>=2.

If, by contrast, the temperature in the combustion chamber lies below the ignition temperature, the exhaust gas return ratio has to be restricted to avoid extinguishing the flame.

Object and Solution

An object addressed by the invention is to provide a device and a method for supplying combustion air and for internally recirculating exhaust gas for a burner, in particular for low temperature processes, with a defined exhaust gas return ratio.

According to a first aspect, a device for supplying combustion air and for recirculating exhaust gas for a burner having a combustion chamber is provided, wherein the device comprises a plurality of driving nozzles which are distributed about a central axis and are fluidically connected to a combustion air supply, and a mixing chamber arranged downstream of the driving nozzles, the driving nozzles and the mixing chamber forming a jet pump, and, wherein in the mixing chamber, combustion air emerging from the driving nozzles is mixable with exhaust gases, which flow out of the combustion chamber and are sucked back by means of the driving nozzles, to form a combustion air/exhaust gas mixture, and the combustion air/exhaust gas mixture is suppliable to a reaction zone downstream of the mixing chamber.

A chamber which is delimited from the surroundings and which has a defined cross section and which is provided between the driving nozzles and the reaction zone of the combustion chamber is referred to as the mixing chamber. The cross section of the mixing chamber can be suitably selected by a person skilled in the art depending on the application. In advantageous embodiments, the cross section in the direction of flow is constant, in one embodiment, a converging or diverging cross section for improved inflow or outflow being provided in an inlet region and/or an outlet region.

The distributed driving nozzles and the mixing chamber form a jet pump, with the exhaust gas return ratio of the combustion air/exhaust gas mixture conveyed through the jet pump depending on a cross-sectional ratio of the mixing chamber and the driving nozzles and on operating parameters, such as a temperature of the recirculated exhaust gas. Thus, by suitable configuration of the mixing chamber and the driving nozzles, the exhaust gas return ratio may be suitably defined in advance by a person skilled in the art for certain operating parameters, for example up to the flame stability limit. In other words, the cross section of the mixing chamber is coordinated with an outlet cross section of the driving nozzle and a number of the driving nozzles.

In one embodiment, an end of the mixing chamber facing the driving nozzles is spaced apart at least in sections in the direction of flow from a wall, on which the driving nozzles are arranged, such that an encircling or interrupted gap is provided which acts as an intake opening of the jet pump, via which an exhaust gas can be sucked back and conveyed into the mixing chamber. In another embodiment, an intake chamber with an opening for sucking up exhaust gas is provided upstream of the mixing chamber. During use, an end of the mixing chamber facing the combustion chamber is arranged upstream of an outlet opening of a fuel supply, with a distance being suitably selectable by a person skilled in the art depending on the application.

Similarly to external exhaust gas recirculation, the combustion air and the exhaust gas are mixed with one another, before mixing with the fuel, in a defined exhaust gas return ratio, which may be dependent on operating parameters, without a quantity of exhaust gas in an exhaust gas tract having to be increased for this purpose as in the case of external exhaust gas recirculation.

The exhaust gas recirculation lowers the flame temperature. The formation rate for nitrogen oxide at flame temperatures of conventional fuels of approx. 2000° C. is approximately 104 ppm/s and drops at 1500° C. to approximately 10 ppm/s. At low flame temperatures and dwell periods in the range of tenths of a second, single-digit nitrogen oxide values can thus be obtained in the exhaust gas.

In conjunction with the application, the arrangement of the driving nozzles distributed about a central axis is also referred to as a ring-shaped arrangement. In one embodiment, the driving nozzles are arranged in parallel. In other embodiments, axes of the driving nozzles are inclined in relation to the central axis. A configuration of the jet pump with a plurality of driving nozzles distributed about a central axis and with a mixing chamber arranged downstream of said driving nozzles results in a small jet pump which can be integrated into existing burners with conventional dimensions. The device is therefore also suitable for retrofitting existing plants.

The device with a jet pump formed by the mixing chamber and the driving nozzles is suitable both for burners in a power range of a few kW and for burners with a MW power range.

In one embodiment, a mixing chamber is provided with an annular cross section. An inside diameter of the mixing chamber is selected here in such a manner that, during use, the mixing chamber can be arranged around a fuel lance provided coaxially with respect to the central axis.

The number of driving nozzles can be suitably determined by a person skilled in the art depending on the application and size of the burner. In one embodiment, eight or more driving nozzles distributed uniformly about the central axis are provided. This provided a good suction effect in particular for a mixing chamber with a supply opening in the form of an annular gap.

A cross-sectional ratio of the mixing chamber and the driving nozzles of the jet pump is configured to obtain a certain exhaust gas return ratio EGR, with a resulting cross section of all of the driving nozzles being referred to as the cross section of the driving nozzles. In one embodiment, the cross-sectional ratio of the mixing chamber and the driving nozzles is smaller than or equal to 20.

As mentioned above, an exhaust gas return ratio EGR that is optimum for avoiding pollutants is also dependent on operating parameters. For example, depending on the temperature of the recirculated exhaust gas, an exhaust gas return ratio EGR of 1 to 1.5 with an oxygen content of the combustion air/exhaust gas mixture of between approx. 10% and approx. 12% is required in order to lower the flame temperature to 1500° C.

In one embodiment, a bypass duct is therefore provided by means of which combustion air can be supplied to the reaction zone, bypassing the driving nozzles. As a result, it is possible, for example, to reduce the EGR for flame stability by some of the combustion air being guided past the driving nozzles via the bypass duct. In one embodiment, the bypass duct is configured as an annular gap duct which, during use, is arranged about a fuel lance and runs in sections between the mixing chamber and the fuel lance. In one embodiment, nozzle openings are provided at an outlet end of the bypass duct in order to achieve rapid and complete mixing of the combustion air, which is supplied via the bypass duct, with the combustion air/exhaust gas mixture of the jet pump.

In one embodiment, an adjustable bypass valve is provided in the bypass duct. In one embodiment, the bypass valve is adjustable merely between an open position and a closed position. In other embodiments, a bypass valve which is adjustable continuously or infinitely variably is provided. In embodiments, the bypass valve is adjusted by means of a controllable or adjustable actuating means, the bypass valve being opened or closed or a passage being varied by means of adjustment or control interventions, depending on the embodiment. For flame stability, an oxygen content of the combustion air/exhaust gas mixture for the combustion can be changed by means of a variable supply of additional combustion air by the bypass valve and in particular kept within a defined range.

Alternatively or additionally to a bypass duct, in one embodiment an adjustable valve is provided in an intake opening for the sucked-back exhaust gas, the valve preferably being adjustable continuously or infinitely variably. For flame stability, an oxygen content of the combustion air/exhaust gas mixture for the combustion can be changed by a variable supply of exhaust gas by the valve in the intake opening for the sucked-back exhaust gas and in particular kept within a defined range.

In one embodiment, a probe is provided for measuring oxygen. The probe is preferably provided upstream of outlet openings of a fuel supply and therefore upstream of a flame. The oxygen content, determined by the probe, of the mixture of the combustion air/exhaust gas mixture supplied by means of the jet pump and optionally the combustion air supplied via the bypass duct can be determined and varied by adjustment or control interventions at the bypass valve and/or at the valve in the intake opening for the sucked-back exhaust gas.

Alternatively or additionally, in one embodiment, a measurement sensor is provided for measuring the temperature of the recirculated exhaust gas. An exhaust gas return ratio optimized for a temperature of the exhaust gas can be determined and adjusted by adjustment or control interventions at the bypass valve and/or at the valve in the intake opening, preferably with the oxygen content being measured.

According to a second aspect, a burner is provided, comprising a device for supplying combustion air and recirculating exhaust gas with a jet pump, wherein the jet pump has a preferably annular-gap-shaped mixing chamber and a plurality of driving nozzles arranged in a ring about a central axis, and a fuel lance which is arranged coaxially with respect to the central axis and has outlet openings. The outlet openings are arranged downstream of an outlet opening of the mixing chamber, with a distance being suitably selectable by a person skilled in the art. In one embodiment, a baffle is provided upstream of the outlet openings of the fuel lance to improve flame stability. The burner provided in such a way can be installed in a conventional chamber.

In one refinement, a flame tube is provided which delimits a reaction zone transversely with respect to the direction of flow. The exhaust gas can flow in an annular gap between a wall of the chamber and the flame tube to the jet pump and/or to an exhaust gas outlet. In one embodiment, the flame tube is arranged directly adjacent to the mixing chamber. A length of the flame tube can be suitably selected by a person skilled in the art depending on the fuel. In one embodiment, for operation with fuels with a low reaction rate, for example natural gas, an extended flame tube is selected for an extended dwell period in order to ensure burnout. Since, however, a dwell period also has an effect on the formation of nitrogen oxides, a short flame tube is provided in other embodiments.

In one embodiment, the fuel lance comprises an ignition device or a pilot burner. An outlet opening of the ignition device or of the pilot burner is preferably offset with respect to the outlet openings of the fuel lance for normal operation.

According to a third aspect, a method is provided for supplying combustion air and for recirculating exhaust gas for a burner having a combustion chamber, wherein combustion air is supplied by means of a plurality of driving nozzles, which are distributed about a central axis, to a mixing chamber arranged downstream of the driving nozzles with exhaust gases being sucked up from the combustion chamber, and, in the mixing chamber, the combustion air emerging from the driving nozzles is mixed with exhaust gases, which flow out of the combustion chamber and are sucked back by means of the driving nozzles, to form a combustion air/exhaust gas mixture, and the combustion air/exhaust gas mixture is supplied to a reaction zone downstream of the mixing chamber.

The driving nozzles and the mixing chamber form a jet pump by means of which a combustion air/exhaust gas mixture with a defined EGR can be supplied to the reaction zone depending on certain operating parameters.

In one embodiment, provision is made that combustion air is selectively supplied via a bypass duct to the reaction zone, bypassing the driving nozzles. The content of the combustion air supplied via the bypass duct is preferably variable in order to undertake an adjustment depending on certain operating parameters.

For this purpose, in one embodiment, an oxygen content of a mixture of the combustion air supplied via the bypass duct and the combustion air/exhaust gas mixture is monitored and a quantity of the combustion air supplied via the bypass duct is adjusted to maintain a defined oxygen content.

Alternatively or additionally, in another embodiment, provision is made that a temperature of the recirculated exhaust gas is detected and a quantity of the combustion air supplied via the bypass duct is adjusted depending on the detected temperature.

BRIEF DESCRIPTION OF THE DRAWINGS

Further advantages and aspects of the invention emerge from the claims and from the description of exemplary embodiments of the invention that are explained below with reference to the figures, in which:

DETAILED DESCRIPTION OF THE EXEMPLARY EMBODIMENTS

Figure 1:
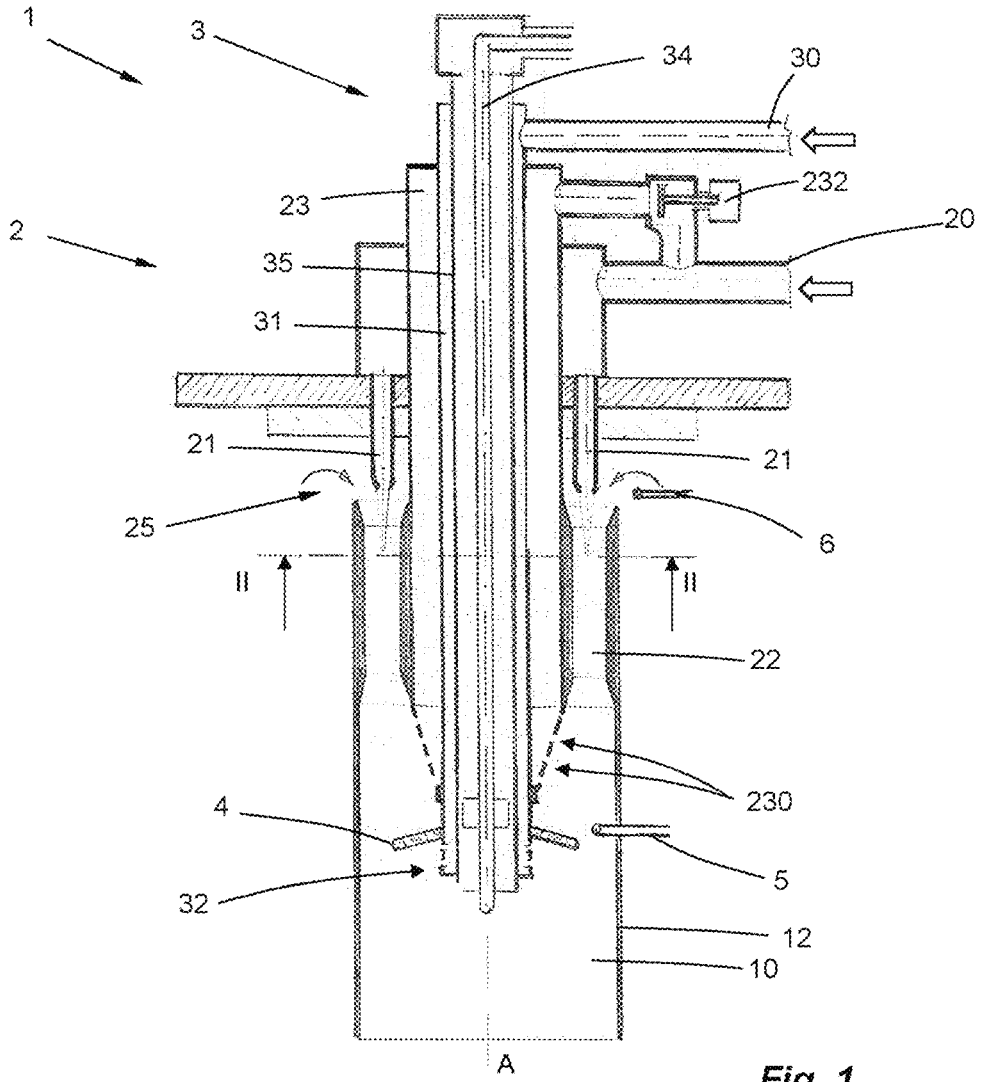
FIG. 1: shows a sectioned side view of a burner with a device for supplying combustion air and for recirculating exhaust gas.
Figure 2:
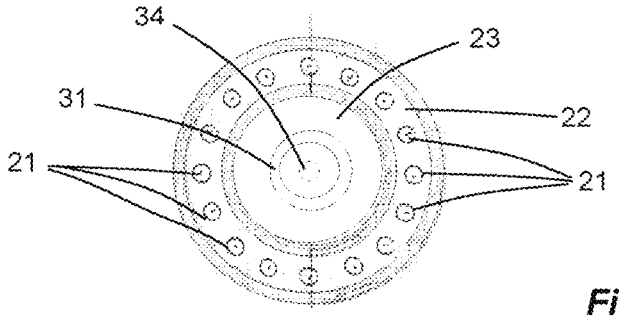
FIG. 2: shows the burner according to FIG. 1 in a sectioned top view according to a marking II-II in FIG. 1.

FIGS. 1 and 2 show a burner 1 having a combustion chamber 10 and having a device 2 for supplying combustion air and for recirculating exhaust gas in a sectioned side view or in a sectioned top view according to a marking II-II in FIG. 1.

The burner 1 which is illustrated has a fuel supply 3 with a supply nozzle 30, a fuel lance 31 running coaxially with respect to a central axis A, and outlet nozzles 32. In the exemplary embodiment which is illustrated, a flame holder 4 for stabilizing a flame front is provided upstream of the outlet nozzles 31. The fuel supply 3 which is illustrated furthermore comprises an internal pilot burner or ignition device 34. The ignition device 34 is arranged in a tube 35 which delimits a duct for supplying fuel in the fuel lance 31 of the fuel supply. The combustion chamber 10 is delimited transversely with respect to the direction of flow by a flame tube 12.

The device 2 comprises a combustion air supply with a supply nozzle 20, a plurality of driving nozzles 21, sixteen in the exemplary embodiment illustrated, which are fluidically connected to the combustion air supply and are distributed about the central axis A and about the fuel lance 31, and a mixing chamber 22 arranged downstream of the driving nozzles 21. The driving nozzles 21 and the mixing chamber 22 form a jet pump. The combustion air supplied by means of the driving nozzles 21 is used here as a driving medium which generates a pumping action such that an exhaust gas flowing out of the combustion chamber 10 is sucked up via an intake opening 25 provided between the driving nozzles 21 and the mixing chamber 22. In the mixing chamber 22, the combustion air emerging from the driving nozzles 21 is mixed with the exhaust gases, which flow out of the combustion chamber 10 and are sucked back by means of the driving nozzles 21, to form a combustion air/exhaust gas mixture, and the combustion air/exhaust gas mixture is supplied to a reaction zone in the combustion chamber 10 downstream of the mixing chamber 22.

The mixing chamber 22 of the illustrated device 2 has an annular cross section and surrounds the fuel lance 31. The flame tube 12 adjoins the mixing chamber 22. In the exemplary embodiment illustrated, the flame tube 12 and the mixing chamber 22 are realized by a common component. In other embodiments, separate components are provided.

The device 2 which is illustrated in FIGS. 1 and 2 furthermore has a bypass duct 23 by means of which combustion air can be supplied to the reaction zone, bypassing the driving nozzles 21. In the exemplary embodiment which is illustrated, the bypass duct 23 is configured as an annular duct running coaxially with respect to the central axis A between the fuel lance 31 and the mixing chamber 22. The bypass duct 23 ends downstream of the mixing chamber 22 and upstream of the flame holder 4. For rapid and complete thorough mixing of the combustion air supplied via the bypass duct 23 with the combustion air/exhaust gas mixture coming from the mixing chamber 22, nozzle openings 230 are provided at an outlet end of the bypass duct 23 in the exemplary embodiment which is illustrated. In the exemplary embodiment which is illustrated, a bypass valve 232 which is adjustable continuously or infinitely variably is provided in the bypass duct 23.

A probe 5 for measuring oxygen is provided downstream of the mixing chamber 22 and, in the exemplary embodiment which is illustrated, downstream of the outlet end of the bypass duct 23 and upstream of the flame holder 4 and of the outlet nozzles 32 of the fuel supply 3.

Furthermore, a measurement sensor 6 for measuring the temperature of the recirculated exhaust gas is provided. In the exemplary embodiment which is illustrated, the measurement sensor 6 is arranged in the region of the intake opening 25 of the jet pump formed by the mixing chamber 22 and the driving nozzles 21.

An exhaust gas return ratio of the combustion air/exhaust gas mixture conveyed by the jet pump depends on a cross-sectional ratio of the mixing chamber 22 and of the driving nozzles 21 and on operating parameters, such as a temperature of the recirculated exhaust gas.

In order to lower a flame temperature to 1500° C., an exhaust gas return ratio of 1 to 1.5 is required depending on the temperature of the returned exhaust gas. A cross-sectional ratio of the mixing chamber 22 and of the driving nozzles 21 is correspondingly suitably configured by a person skilled in the art for a temperature range of the returned exhaust gas. In the exemplary embodiment which is illustrated, the cross-sectional ratio is selected to be smaller than 20. The mixing chamber 22 which is illustrated has funnel-shaped inflow and outflow regions. A cross section of the mixing chamber 22 is determined here in a section located in between with a constant cross section.

If an exhaust gas return ratio has to be reduced during the operation in order to obtain flame stability, for example because of deviations in the temperature of the returned exhaust gas, some of the combustion air can be supplied via the bypass duct 23 in the exemplary embodiment which is illustrated. The probe 5 can be used to detect an oxygen content and adjust it to a certain value using the bypass valve 232.

Figure 3:
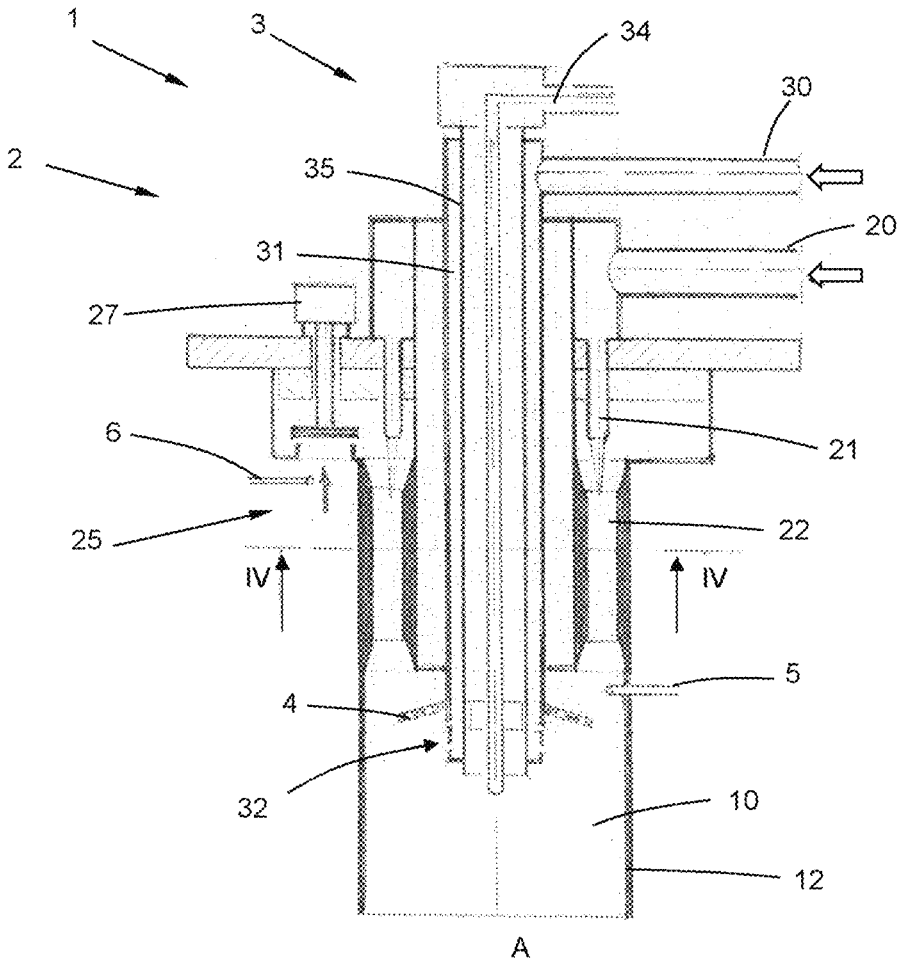
FIG. 3: shows a sectioned side view of a burner similarly to FIG. 1 with a device for supplying combustion air and for recirculating exhaust gas.
Figure 4:
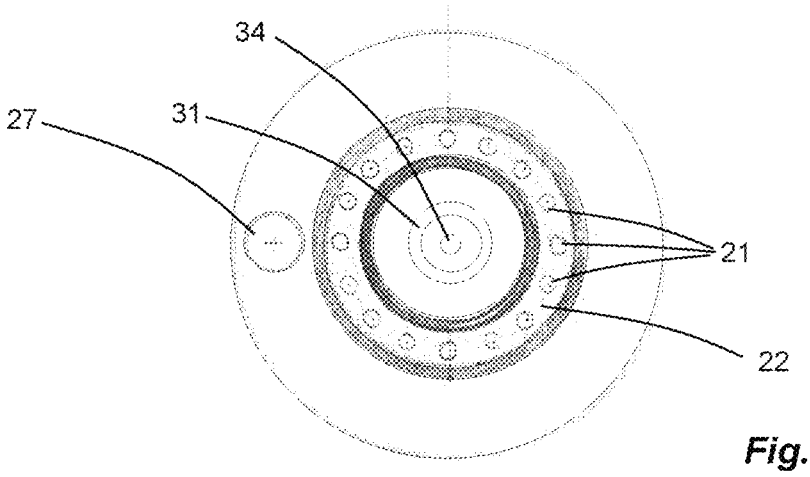
FIG. 4: shows the burner according to FIG. 3 in a sectioned top view according to a marking IV-IV in FIG. 3.

FIGS. 3 and 4 show a burner 1 having a combustion chamber 10 and having a device 2 for supplying combustion air and for recirculating exhaust gas in a sectioned side view or in a sectioned top view according to a marking II-II in FIG. 1. The burner 1 according to FIGS. 3 and 4 are similar to the burner 1 according to FIGS. 1 and 2, and uniform reference signs are used for identical components. A detailed description of components which have already been described is omitted.

In contrast to the exemplary embodiment according to FIGS. 1 and 2, the device 2 according to FIGS. 3 and 4 does not have a bypass duct 23. Instead, a continuously or infinitely variably adjustable valve 27 is provided in the intake opening 25 for the sucked-back exhaust gas. If an exhaust gas return ratio has to be reduced during the operation in order to obtain flame stability, in the exemplary embodiment according to FIGS. 3 and 4 return of exhaust gas can be reduced by means of the valve 27. In this case, analogously to the exemplary embodiment according to FIGS. 1 and 2, the probe 5 can be used to detect an oxygen content of the combustion air/exhaust gas mixture upstream of the outlet nozzles 32 of the fuel supply and—in contrast to the exemplary embodiment according to FIGS. 1 and 2—to adjust same to a certain value with the aid of the valve 27. In the exemplary embodiment which is illustrated, an annular cavity which can be used, for example, for wiring of the probe 5 remains between the fuel lance 31 of the fuel supply 3 and the mixing chamber 22. In other embodiments, an inside diameter of the annular mixing chamber 22 is identical to an outside diameter of the duct 31, thus not leaving a cavity.

Figure 5:
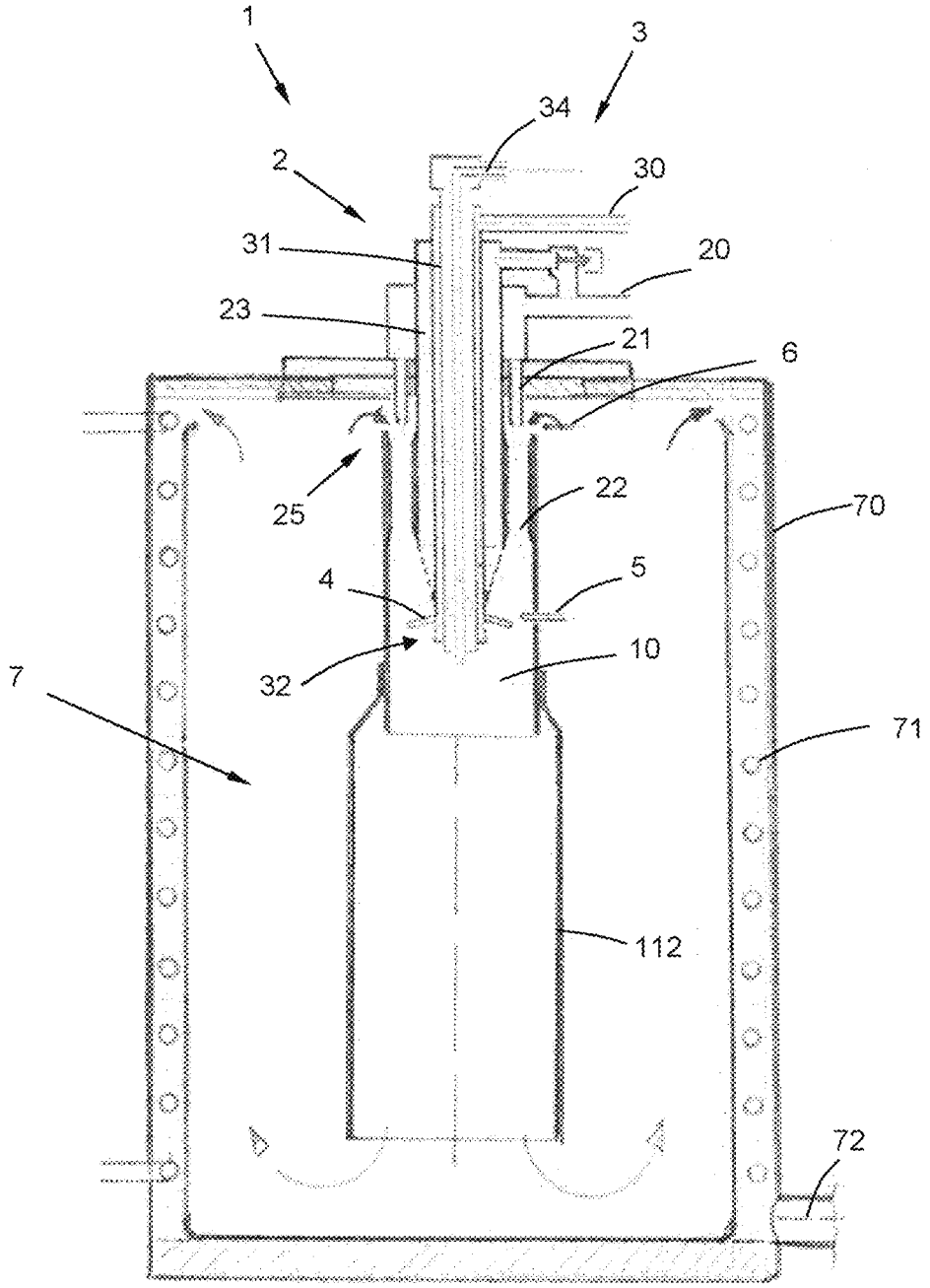
FIG. 5: shows a burner similarly to FIG. 1 in a sectioned side view with a chamber.

FIG. 5 shows the burner 1 according to FIG. 1 and a heating chamber 7 which is delimited by a housing 70. A double-walled housing 70 is provided in the exemplary embodiment which is illustrated. Arranged in the double-walled housing 70 is a tube coil 71 through which a medium to be heated is guided. The exhaust gas or combustion gas is guided through the double-walled housing 70 to an outlet 72 and, in the process, heats the medium guided in the tube coil. In addition, to avoid thermal formation of nitrogen oxides, some of the exhaust gas is sucked up by the jet pump, which is formed by the driving nozzles 21 and the mixing chamber 22, and mixed with the combustion air.

In contrast to the embodiment according to FIGS. 1 and 2, in the embodiment according to FIG. 5, for operation with fuels with a low reaction rate, for example natural gas, an extended flame tube 112 is provided for an extended dwell period in order to ensure burnout.

What is claimed is:

1. A device for supplying combustion air and for recirculating exhaust gas for a burner having a burner chamber, wherein the device comprises a plurality of driving nozzles which are distributed about a central axis and are fluidically connected to a combustion air supply, wherein a mixing chamber arranged downstream of the driving nozzles is provided, the driving nozzles and the mixing chamber forming a jet pump, wherein in the mixing chamber, combustion air emerging from the driving nozzles is mixable with exhaust gases, which flow out of the combustion chamber and are sucked back by means of the driving nozzles, to form a combustion air/exhaust gas mixture, and the combustion air/exhaust gas mixture is suppliable to a reaction zone downstream of the mixing chamber, wherein a bypass duct is provided by means of which combustion air can be supplied to the reaction zone, bypassing the driving nozzles, and wherein an adjustable bypass valve is provided in the bypass duct.

2. The device as claimed in claim 1, wherein the mixing chamber has an annular cross section.

3. The device as claimed in claim 1, wherein eight or more driving nozzles which are distributed uniformly about the central axis are provided.

4. The device as claimed in claim 1, wherein a cross-sectional ratio of the mixing chamber and the driving nozzles is smaller than or equal to 20.

5. The device as claimed in claim 1, wherein nozzle openings are provided at an outlet end of the bypass duct.

6. The device as claimed in claim 1, wherein the bypass valve is adjustable continuously or infinitely variably.

7. The device as claimed in claim 1, wherein an adjustable valve is provided in an intake opening for the sucked-back exhaust gas.

8. The device as claimed in claim 1, wherein at least one of a probe for measuring oxygen and a measurement sensor for measuring the temperature of the recirculated exhaust gas is provided.

9. A burner comprising a device as claimed in claim 1, and a fuel lance which is arranged coaxially with respect to the central axis and has outlet openings.

10. The burner as claimed in claim 9, wherein a flame tube is provided which delimits the combustion chamber transversely with respect to the direction of flow.

11. The burner as claimed in claim 9, wherein the fuel supply comprises an ignition device or a pilot burner.

12. A method for supplying combustion air and for recirculating exhaust gas for a burner having a combustion chamber, wherein combustion air is supplied by means of a plurality of driving nozzles, which are distributed about a central axis, to a mixing chamber arranged downstream of the driving nozzles with exhaust gases being sucked up from the combustion chamber, and, in the mixing chamber, the combustion air emerging from the driving nozzles is mixed with exhaust gases, which flow out of the combustion chamber and are sucked back by means of the driving nozzles, to form a combustion air/exhaust gas mixture, and the combustion air/exhaust gas mixture is supplied to a reaction zone downstream of the mixing chamber, wherein combustion air is selectively supplied via a bypass duct to the reaction zone, bypassing the driving nozzles, and wherein an oxygen content of a mixture of the combustion air supplied selectively via the bypass duct and the combustion air/exhaust gas mixture is monitored and a quantity of the combustion air supplied via the bypass duct is adjusted to maintain a defined oxygen content.

13. A method for supplying combustion air and for recirculating exhaust gas for a burner having a combustion chamber, wherein combustion air is supplied by means of a plurality of driving nozzles, which are distributed about a central axis, to a mixing chamber arranged downstream of the driving nozzles with exhaust gases being sucked up from the combustion chamber, and, in the mixing chamber, the combustion air emerging from the driving nozzles is mixed with exhaust gases, which flow out of the combustion chamber and are sucked back by means of the driving nozzles, to form a combustion air/exhaust gas mixture, and the combustion air/exhaust gas mixture is supplied to a reaction zone downstream of the mixing chamber, wherein combustion air is selectively supplied via a bypass duct to the reaction zone, bypassing the driving nozzles, and wherein a temperature of the recirculated exhaust gas is detected and a quantity of the combustion air supplied via the bypass duct is adjusted depending on the detected temperature.

14. The device as claimed in claim 7, wherein the adjustable valve is adjustable continuously or infinitely variably.

15. The device as claimed in claim 8, wherein the probe is provided upstream of outlet openings of a fuel supply.

* * * * *